US010076914B2

(12) United States Patent
Chen et al.

(10) Patent No.: US 10,076,914 B2
(45) Date of Patent: Sep. 18, 2018

(54) FLUID EJECTION DEVICE WITH FLUID FEED HOLES

(71) Applicant: HEWLETT-PACKARD DEVELOPMENT COMPANY, L.P., Houston, TX (US)

(72) Inventors: Chien Hua Chen, Corvallis, OR (US); Michael W Cumbie, Corvallis, OR (US); Erik D Torniainen, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/545,013

(22) PCT Filed: Feb. 27, 2015

(86) PCT No.: PCT/US2015/017998

§ 371 (c)(1),
(2) Date: Jul. 20, 2017

(87) PCT Pub. No.: WO2016/137490

PCT Pub. Date: Sep. 1, 2016

(65) Prior Publication Data

US 2018/0015732 A1 Jan. 18, 2018

(51) Int. Cl.

| | |
|---|---|
| ***B41J 2/16*** | (2006.01) |
| ***B41J 2/19*** | (2006.01) |
| ***B41J 2/14*** | (2006.01) |

(52) U.S. Cl.

CPC ..... *B41J 2/19* (2013.01); *B41J 2/1404* (2013.01); *B41J 2/14201* (2013.01); *B41J 2/1601* (2013.01); *B41J 2/1607* (2013.01); *B41J 2/1637* (2013.01); *B41J 2002/14419* (2013.01)

(58) Field of Classification Search

CPC ..... B41J 2/1637; B41J 2/1607; B41J 2/1601; B41J 2/14201; B41J 2002/14419

See application file for complete search history.

(56) References Cited

U.S. PATENT DOCUMENTS

| | | | |
|---|---|---|---|
| 5,463,413 A | 10/1995 | Ho et al. | |
| 5,666,143 A | 9/1997 | Burke et al. | |
| 5,734,399 A | 3/1998 | Weber et al. | |
| 5,912,685 A | 6/1999 | Raman | |
| 6,007,188 A | 12/1999 | MacLeod et al. | |
| 9,446,587 B2 * | 9/2016 | Chen | B41J 2/14072 |

* cited by examiner

*Primary Examiner* — Sharon A Polk
(74) *Attorney, Agent, or Firm* — HP Inc. Patent Department

(57) ABSTRACT

A fluid ejection die has a substrate through which an array of fluid feed holes is formed. The fluid feed holes are separated by ribs. Each fluid feed hole is to guide fluid to an array of drop generators.

16 Claims, 10 Drawing Sheets

FLUID EJECTION DEVICE WITH FLUID FEED HOLES

BACKGROUND

Fluid ejection devices eject drops on demand. For example, fluid ejection devices are present in three-dimensional (3D) printers, two-dimensional (2D) printers, such as inkjet printers, and other high precision digital dispensing devices, such as digital titration devices.

Inkjet printers print images by ejecting ink drops through a plurality of nozzles onto a print medium, such as paper. Nozzles are typically arranged along a printhead in one or more arrays, such that properly sequenced ejection of ink drops from the nozzles causes characters or other images to be printed on the print medium as the printhead and the print medium move relative to each other. Thermal inkjet printheads eject drops from nozzles by passing electrical current through heating elements that generate heat and vaporize small portions of fluid within firing chambers. Piezoelectric inkjet printheads use piezoelectric material actuators to generate pressure pulses that force ink drops out of nozzles.

BRIEF DESCRIPTION OF THE DRAWINGS

Examples will now be described with reference to the accompanying drawings, in which.

DETAILED DESCRIPTION

Figure 1:
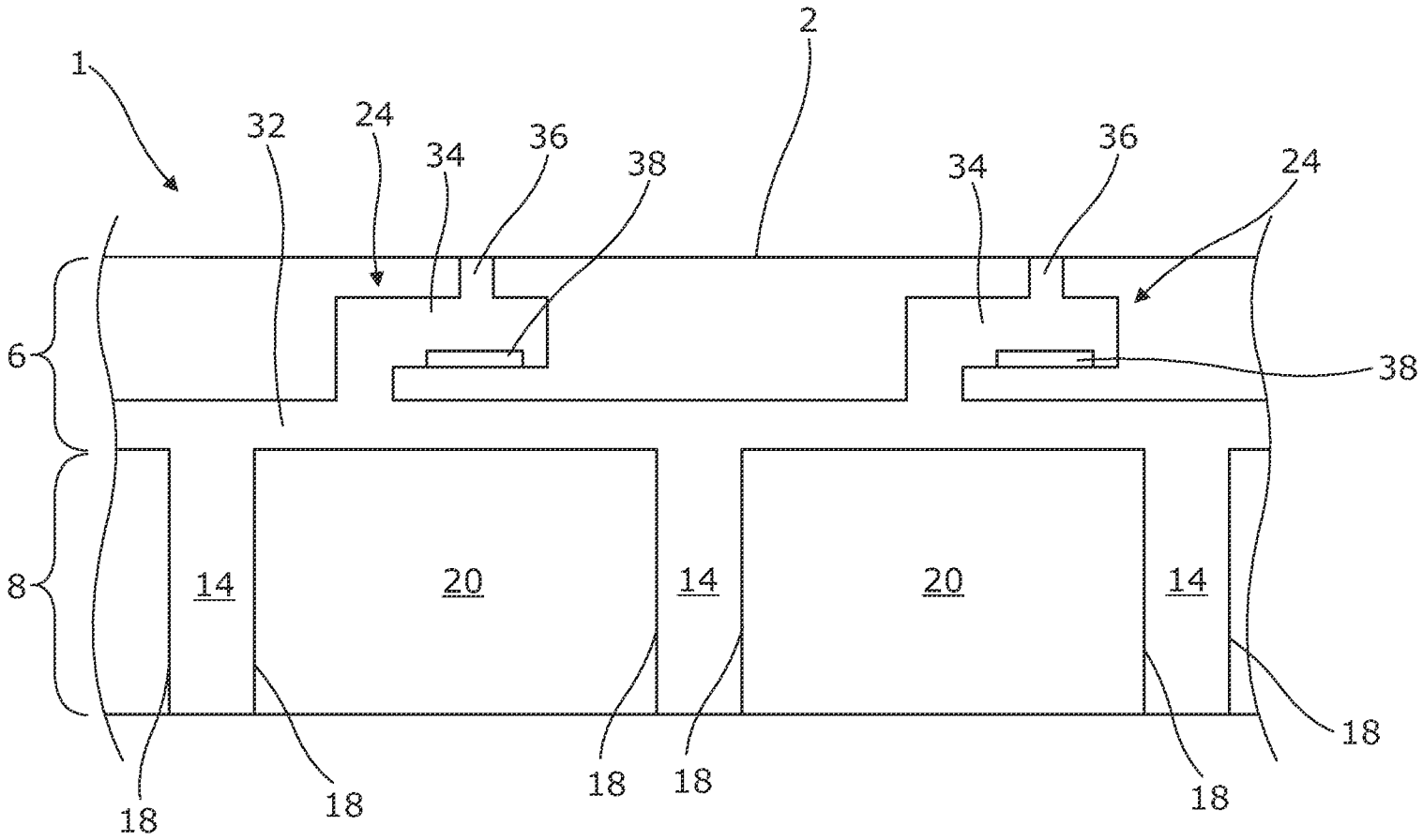
FIG. 1 is a diagram of a cross-sectional view of an example fluid ejection device.

When manufacturing fluid ejection devices, it can be a challenge to reduce a width and/or thickness of a substrate of a die while maintaining or increasing nozzle density. Some silicon die architectures include longitudinal fluid feed slots formed through the silicon die substrate. These longitudinal fluid feed slots enable fluid to flow from a fluid distribution manifold (e.g., a plastic interposer or chiclet) at the back surface of the die, through the die, and to one or two full rows of fluid ejection chambers and nozzles on the front surface of the die. Said manifold and longitudinal fluid feed slots provide fluidic fan-out from the downstream microscopic ejection chambers to upstream larger fluid supply channels. The longitudinal fluid feed slots take up die space and may decrease the structural integrity of the die. In other examples, the fluid slots add complexity and cost to the process of integrating the die with the manifold. Reducing a slot pitch to achieve a smaller overall die width, where a die has multiple slots, can be complicated, for example for integrating the die with the manifold. Thus, according to one example of this disclosure, it has been found that an amount of die shrink can be limited by the integration of the plastic manifold with reduced-pitch die slots.

In another example, it has been found that the amount of die shrink and nozzle density can be limited by fluidic cross-talk that occurs as fluid drop generators are brought in closer proximity to one another. In general, fluidic cross-talk occurs when the ejection of a fluid drop from the nozzle of one drop generator affects the fluid mechanics in neighboring drop generators. Pressure waves created by the ejection of fluid from a chamber/nozzle can propagate into adjacent fluid chambers and cause fluid displacements. The resulting volume changes in adjacent chambers can adversely affect the drop ejection processes in the adjacent chambers (e.g., drop volume, drop shape, drop ejection speed, chamber refill).

In one example of this disclosure, fluid ejection devices do not have longitudinal fluid slots formed from the back to the front of a substrate, to feed fluid to nozzle arrays. Instead, a narrow "sliver" die is molded into a monolithic molded body that provides fluidic fan-out through molded channels at the back surface of the die. This may eliminate the need for costly and complex integration of the die with a manifold at the back surface of the die. The die may be provided with a substrate at the back and a fluidic layer at the front. Each molded channel may provide fluid to the back surface of the substrate. The fluid reaches drop generators in the fluidic layer through an array of fluid feed holes (FFHs) formed in the substrate. The fluid feed holes are separated from each other and may be arranged in a row, parallel to the row of nozzles. Bridges, or ribs, between the fluid feed holes provide strength to the substrate. In this disclosure, the mold-sliver type of fluid ejection device is referred to as molded fluid ejection device.

The mold-sliver design can enable a relatively small width of the die. In one example, the nozzle density can be increased when the two parallel rows of fluid drop generators along either side of the FFH array are brought relatively close to one another. Example pillar structures formed in the fluidic layer may mitigate fluidic cross-talk and/or bubble formation that could otherwise manifest themselves near fluid ejection chambers that are in close proximity. Such pillar structures may impede the movement of particles and air bubbles within the fluidic layer, which in turn may help in prevent clogging of the ejection chambers and nozzles.

Thus, in addition to enabling a relatively small die size and high nozzle density, the molded fluid ejection device may incorporate features that help to overcome issues related to fluidic cross-talk and clogging that otherwise would have limited an ability to reduce die size and increase nozzle density.

In one example, a fluid ejection device includes a die molded into a molding. The die has a fluidics layer with a front surface exposed outside the molding to dispense fluid and a substrate with a front surface on which the fluidics layer is formed and a back surface to receive fluid through at least one channel in the molding. An array of fluid feed holes is provided in the die substrate to enable fluid flow from the back surface to the fluidics layer on the front surface. An array of drop generators in the fluidics layer may extend parallel to the array of fluid feed holes, along the outlets of the fluid feed holes. In an example, an array of drop generators extends at either side of the fluid feed holes. The fluid feed holes may traverse bulk silicon and silicon ribs can be interleaved between the fluid feed holes, with each rib traversing at least a part of the molding channel.

In one example a media wide fluid ejection assembly is provided. Such fluid ejection assembly is to eject drops over a complete media width, for example in a 2D or 3D printer. Examples of media are paper and powder. In an example, fluid ejection assembly includes a plurality of fluid ejection dies embedded in a molding. Each die includes a die substrate forming a back surface of the die and having an array of fluid feed holes to convey fluid from a channel in the molding at the back surface to at least one parallel array of drop generators on an opposing front surface. Silicon ribs are interleaved between the fluid feed holes and extend across at least part of the channel. In an example the ribs extend up to near the front surface, between parallel arrays of drop generators. As used in this document, a "fluid ejection device" and a "fluid ejection die" refer to a device that can dispense fluid from one or more nozzles. A fluid ejection device may include one or more fluid ejection dies. A fluid ejection device may be molded into a molding. Depending on the context, the fluid ejection device may include the molding into which the dies have been embedded. A "sliver" means a fluid ejection die with a ratio of length to width of 50 or more. A fluid ejection device and fluid ejection die can be used in two-dimensional or three dimensional printing applications, for example to dispense ink, agents, or other fluids. In addition to printing applications, the fluid ejection device can be used in digital titration devices, laboratory equipment, pharmaceutical dispensing units, or any other high precision digital dispensing unit.

FIG. 1 illustrates an example diagram of a fluid ejection device 1. In this example, the fluid ejection 1 includes a fluid ejection die 2. The fluid ejection die 2 includes a fluidics layer 6, at a front of the die 2, and a substrate 8, at a back of the die 2. An array (e.g. row) of fluid feed holes 14 is arranged along the substrate 8, wherein each fluid feed hole 14 runs through the substrate 8 from a back of the substrate 8 to a front of the substrate 8, to the fluidics layer 6. Ribs 20 are interleaved between the fluid feed holes 14, thereby defining sidewalls 18 of the fluid feed holes 14. In the Figure, a front and back surface are at a top and bottom, respectively, while in an example scenario, the fluidics layer 6 extends at the bottom and the substrate 8 at the top. The fluidics layer 6 includes an array (e.g. row) of drop generators 24. The array of drop generators 24 may extend parallel to the array of fluid feed holes 14, along, and downstream of, the fluid feed hole openings. Each drop generator 24 includes an ejection chamber 34 and a nozzle 36. The array of drop generators 24 extends perpendicular to a media advance direction. An ejection element 38 is provided in each ejection chamber 34, to eject fluid out of the nozzle 36. A manifold layer 32 can be provided between the drop generators 24 and the fluid feed holes 14 to guide the fluid from the fluid feed holes to the chambers 34.

In one example, the fluid feed holes 14 with interleaved ribs 20 can provide for a relatively strong and mechanically stable fluid ejection die 2. This may allow the die 2 to be made of a relatively small width, for example smaller than fluid ejection dies that have longitudinal fluid slots cut through a silicon substrate. Such a relatively small width die may be combined with a relatively high nozzle and drop generator density.

Figure 2:
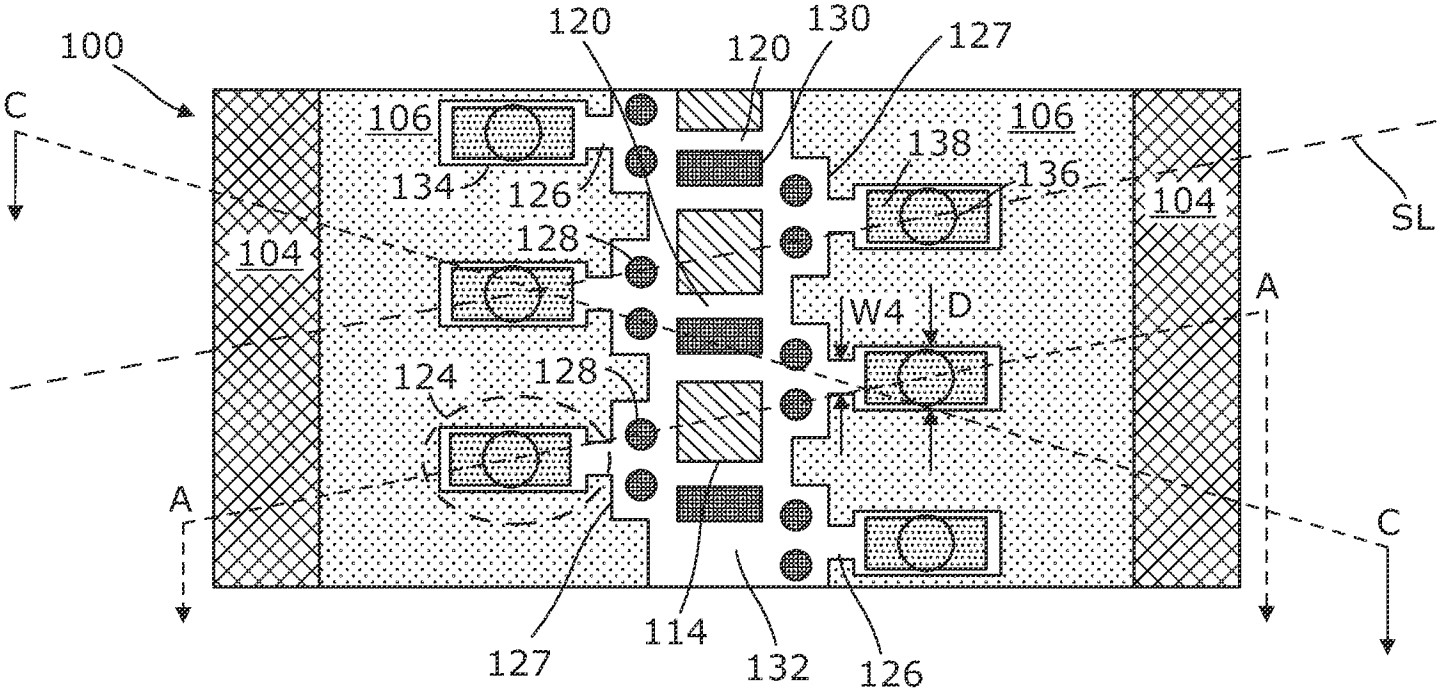
FIG. 2 is an elevation section view illustrating a portion of an example molded fluid ejection device.
Figure 3:
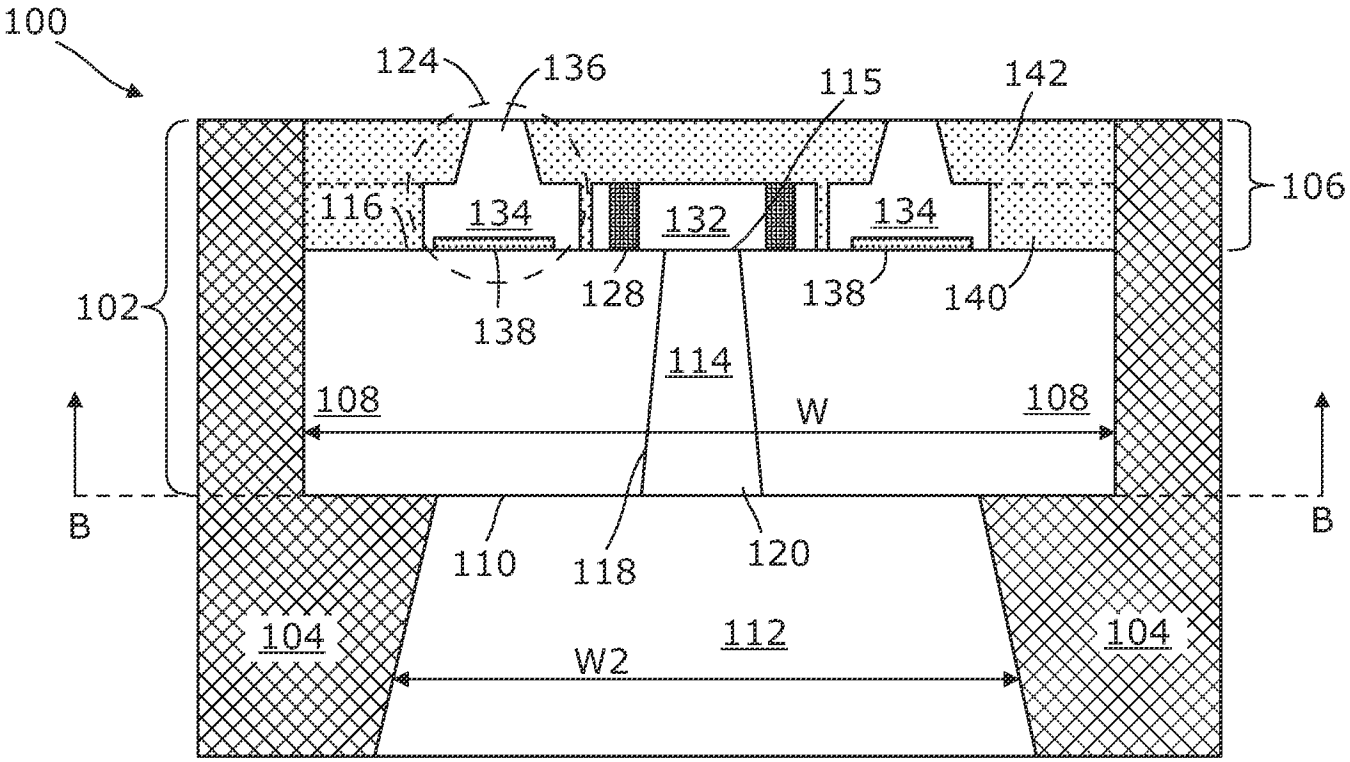
FIG. 3 is a cross-sectional view of the example molded fluid ejection device of FIG. 2, taken along a dashed line A-A of FIG. 2.
Figure 4:
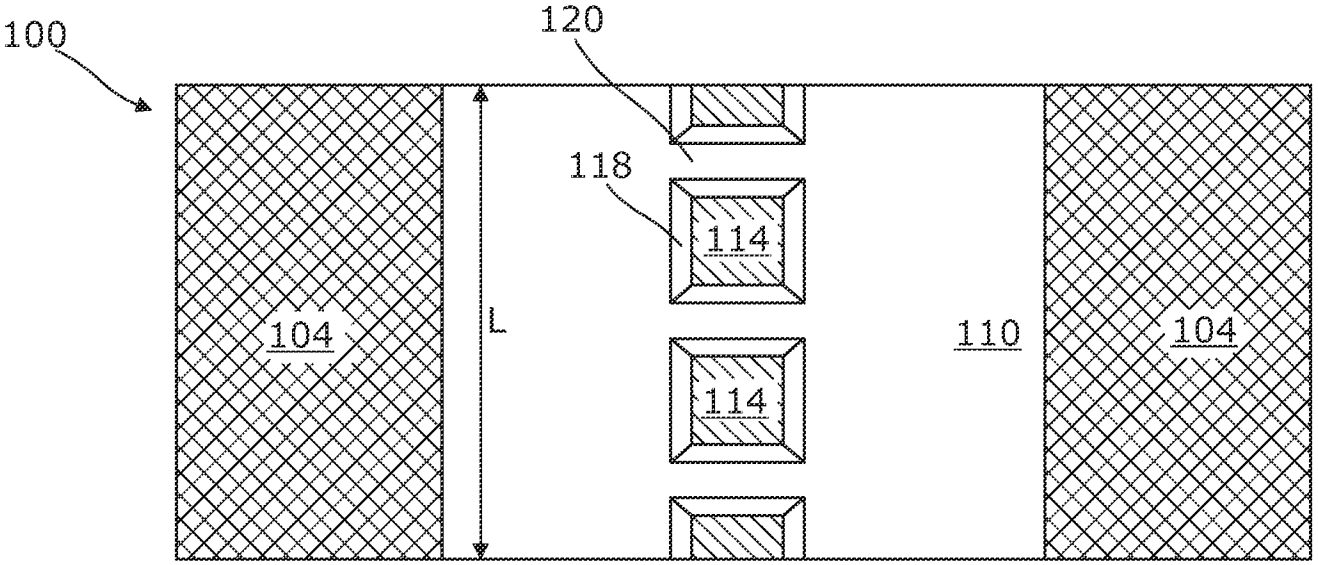
FIG. 4 illustrates a cross-sectional view from the bottom of the example molded fluid ejection device of FIG. 2, taken along the dotted line B-B of FIG. 3.
Figure 5:
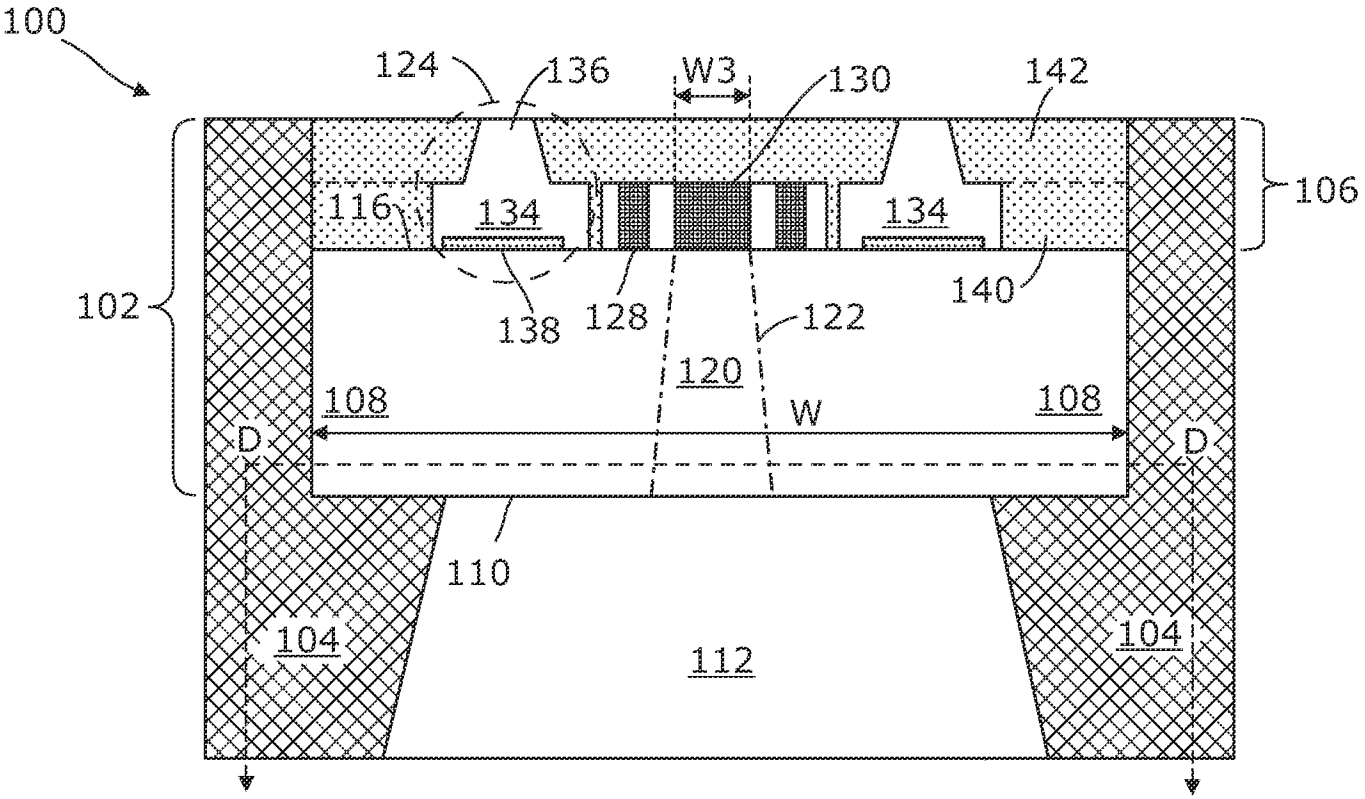
FIG. 5 is a cross-sectional view of the example molded fluid ejection device of FIG. 2, taken along the dashed line C-C of FIG. 2.

FIGS. 2-5 illustrate a portion of another example molded fluid ejection device 100 in several different views. FIG. 2 illustrates a plan view of an example molded fluid ejection device 100, FIG. 3 illustrates a cross-sectional side view of the fluid ejection device 100 taken along the dotted line A-A of FIG. 2, FIG. 4 illustrates a view from the bottom of the fluid ejection device 100 taken along the dotted line B-B of FIG. 3, and FIG. 5 illustrates a cross-sectional side view of the fluid ejection device 100 taken along the dotted line C-C of FIG. 2.

Referring to FIGS. 2-5, the molded fluid ejection device 100 includes an elongated thin "sliver" fluid ejection die 102 molded into a monolithic body 104, or molding 104. The die 102 can be made of silicon, for example SUB. The molding 104 can be formed of plastic, epoxy mold compound, or other moldable material. The fluid ejection die 102 is molded into the molding 104 such that a front surface of a fluidics layer 106 on the die 102 remains exposed outside of the molding 104, enabling the die to dispense fluid. A substrate 108 forms the back surface 110 of the die 102 which is covered by the molding 104 except at a channel 112 formed in the molding 104. The mold channel 112 enables fluid to flow directly to the die 102. In different examples, a fluid ejection device 100 includes one or multiple fluid ejection dies 102 embedded within a monolithic molding 104, with the fluid channel 112 formed in the molding 104 for each die 102 to carry fluid directly to the back surface 110 of the die 102.

In one example, the substrate 108 comprises a thin sliver in the order of 100 microns in thickness. The substrate 108 includes fluid feed holes 114 dry etched or otherwise formed in the substrate 108 to convey fluid through the substrate 108 from its back surface 110 to its front surface 116. In one example, the fluid feed holes 114 completely traverse a substrate 108 composed of bulk silicon. The fluid feed holes 114 are arranged in an array (i.e., a row or line) that may extend along a length (L) of the substrate 108, parallel to the mold channel 112, for example centered with respect to a width W2 of the mold channel 112. In a further example the fluid feed hole array is also centrally located with respect to a width (W) of the substrate 108. In other words, a line or row of fluid feed holes 114 may run down the center of the substrate 108 along its length (L). It is noted that the length (L) illustrated in FIG. 4, for example, is not intended to illustrate the full length of the substrate 108. Instead, the length (L) is intended to indicate the orientation of length to width of the substrate 108. As noted above, FIGS. 2-4 illustrate just a portion of an example molded fluid ejection device 100. In many instances, the substrate 108 would be significantly longer than the length (L) and the number of fluid feed holes 114 would be significantly greater than the several that are illustrated. A single mold channel 112 in the mold 104 may supply fluid to the array of fluid feed holes 114.

In an example, the fluid feed holes 114 include a walls 118 that are tapered from the front surface 116 to the back surface 110 of the substrate 108. Such tapered fluid feed holes 114 have a smaller or narrower cross section at the front surface 116 of the substrate 108 and they become increasingly larger or wider as they extend through the substrate 108 to the back surface 110. Therefore, while the dimensions of the various features of fluid ejection device 100 illustrated in FIGS. 2-5 are not drawn to scale, the openings for the fluid feed holes 114 illustrated in the plan view of FIG. 2 may appear smaller than the openings in the fluid feed holes 114 illustrated in the bottom view of the fluid ejection device 100 illustrated in FIG. 4. In one instance, the tapered fluid feed holes 114 help to manage air bubbles that develop in the fluid ejection device 100. Ink or other liquids may contain varying amounts of dissolved air, and as fluid temperatures increase during fluid drop ejections, the solubility of air in the fluid decreases. The result can be a relatively few air bubbles in the ink or other liquid thereby inhibiting certain consequences of air bubbles in the liquid which may include faulty nozzle performance or reduced print quality. During fluid ejection, because nozzles 136 may be oriented below the fluid feed holes 114, air bubbles developing in fluid ejection chambers 134 and elsewhere in the fluid ejection device 100 may tend to rise upwards through the fluid feed holes 114. Such upward motion of the air bubbles away from the nozzles 136 and chambers 134 may be assisted by the widening taper 118 in the fluid feed holes 114.

The substrate 108 also includes ribs 120 or bridges that traverse the fluid channel 112 between the fluid feed holes 114 on either side of the fluid feed holes 114. The ribs 120 may result from the formation and presence of the fluid feed holes 114. Each rib 120 is positioned between two fluid feed holes 114 and extends widthwise across the substrate 108 as it traverses the underlying fluid channel 112 formed in the molding 104. In an example, the substrate is made of bulk silicon and the ribs 120 are part of the bulk silicon, traversing part of the molded channel of the mold 104.

In FIG. 2, a dashed line C-C indicates a cross-sectional view of the fluid ejection device 100 as illustrated in FIG. 5. The cross-sectional view of fluid ejection device 100 in FIG. 5 illustrates a silicon rib 120 that extends between fluid feed holes 114 and a front and back surface 116, 110 of the substrate 108. The partially dashed line 118 in FIG. 5 represents the outline of a tapered fluid feed hole wall 118 behind (or in front of) the silicon rib 120. The widening taper 118 of the fluid feed holes 114 from the front surface 116 to the back surface 110 of the substrate 108 causes a narrowing of the ribs 120 as the ribs extend from the front surface to the back surface.

The fluid feed holes 114 with interleaved ribs 120 traversing the fluid channel 112 provide increased strength and mechanical stability to the fluid ejection die 102. This allows the die 102 to be made smaller than conventional fluid ejection dies having fluid slots cut completely through a silicon substrate.

In one example, the reduced die size may increase nozzle and drop generator density. By bringing opposite drop generators 124 (i.e. ejection chambers, resistors and nozzles) in opposite drop generator arrays closer to one another, the fluid ejection die 102 can be made of a relatively small width (W). For example, at the time of writing this disclosure, the reduction in die size of the fluid ejection die 102 in a molded fluid ejection device 100 according to an example of this disclosure, compared to a silicon printhead with longitudinal fluid slot, can be in the order of two to four times. For example, while at the time of writing this disclosure some of these printheads with longitudinal fluid feed slots can support two parallel nozzle arrays on a silicon die having width of approximately 2000 microns, the fluid ejection die "sliver"-in-mold of this disclosure can support two opposite, parallel nozzle arrays on a silicon die 102 having a width W of approximately 350 microns. In different examples the width W of the die 102 may be between approximately 150 and 550 microns. In further examples one or two nozzle arrays are disposed within 200 microns of substrate width W.

As illustrated in FIGS. 3 and 5, formed on the front surface 116 of substrate 108 is a fluidics layer 106. The fluidics layer 106 generally defines a fluidic architecture that includes fluid drop generators 124, pillar structures 128, 130, and a manifold channel or manifold 132. Each fluid drop generator 124 includes a fluid ejection chamber 134, a nozzle 136, a chamber inlet 126, and an ejection element 138 formed on the substrate 108 that can be activated to eject fluid from the chamber 134 through the nozzle 136. A common manifold fluidically links each fluid feed hole 114 to the inlets 126. In the illustrated example, two rows of drop generators 124 extend lengthwise at either side of the fluid feed hole array, parallel to the fluid feed hole array.

In different implementations, the fluidics layer 106 may comprise a single monolithic layer or it may comprise multiple layers. For example, the fluidics layer 106 may be formed of both a chamber layer 140 (also referred to as a barrier layer) and a separately formed nozzle layer 142 (also referred to as a tophat layer) over the chamber layer 140. All or a substantial portion of the layer or layers making up the fluidics layer 106 can be formed of an SU8 Epoxy or some other polyimide material, and can be formed using various processes including a spin coating process and a lamination process.

In a further example a location and pitch of each fluid feed hole 114 of the array is such that a center of each fluid feed hole 114 extends approximately between the centers of the closest ejection chambers 134 at either side. For example, if in a top view (e.g. FIG. 2), one would draw a straight line SL through nearest center points of approximately opposite nozzles 136, then the straight line SL would cross the center of the fluid feed hole 114 between these nozzles 136, or a center of a rib 120. In a further example, in a top view (e.g. FIG. 2), in a die 102, any line (e.g. SL) that can be drawn through a center of a fluid feed hole 114 and a center of an ejection chamber 134 is not parallel to a media advance direction.

During printing, fluid is ejected from the ejection chambers 134 through corresponding nozzles 136 and is replenished with fluid from the mold channel 112. Fluid from the channel 112 flows through the feed holes 114 and into the manifold 132. From the manifold 132, fluid flows through the chamber inlets 126 into the ejection chambers 134. Printing speeds can be increased by rapidly refilling the ejection chambers 134 with fluid. However, as fluid flows towards and into the chambers 134, small particles in the fluid can get lodged in and around the chamber inlets 126 that lead to the chambers 134. These small particles can diminish and/or completely block the flow of fluid to the chambers, which can result in the premature failure of the ejection elements 138, reduced ink drop size, misdirected ink drops, and so on. Pillar structures 128 near the chamber inlets 126 provide for a particle-tolerant architecture (PTA) that may serve, at least in part, as a barrier to prevent particles from blocking or passing through the chamber inlets 126. The placement, size, and spacing of the PTA pillars 128 are generally designed to prevent particles, even of a relatively small size, from blocking the inlets 126 to the ejection chambers 134. In the illustrated example the PTA pillars 128 are disposed adjacent to the inlet. For example two PTA pillars 128 can be provided at a distance to the inlet opening of approximately two times a pillar diameter or less, or approximately one time a pillar diameter or less. In a further example, at least one PTA pillar 128 is disposed in an inlet bay 127 into which an inlet 126 opens. In such example, inlet bay 127 arrays may be provided in the manifold side walls, between the manifold 132 and each inlet 126. In other examples, one or three PTA pillars 128 or more can be provided near the inlet 126, to inhibit migration of particles towards the chambers 134.

In a further example, the inlet 126 to the chamber 134 is pinched, that is, a maximum width W4 of each inlet 126 is less than a diameter D of each corresponding chamber 134, wherein the direction of the measured width W4 and diameter D is parallel to a length axis of the manifold 132 or to the length axis of the fluid feed hole array. For example the maximum width W4 of the inlet 126 is less than two third of a diameter D of the chamber. In one example, the pinch point may reduce cross talk. In another example, the pinched inlet may reduce influences of variations in fluid feed hole size, position or lengths.

Additional pillar structures 130 comprise bubble-tolerant architectures 130 (BTA) that are generally configured to impede the movement of air bubbles through the die manifold 132 and to guide air bubbles into the tapered fluid feed holes 114 where they can float upward and away from the downward facing drop generator nozzles 136. The BTA pillars 130 can be disposed in the manifold 132 between the fluid feed holes 114 openings on top of the ribs 120. In an example, the BTA pillars 130 may have a larger volume or width than the PTA pillars 128. For example the BTA pillars may have a width W3 that is at least half the diameter of the fluid feed hole opening 115 into the manifold 132, for example approximately the same as the diameter of the fluid feed hole opening 115 into the manifold 132. It is noted that although in this illustrative description it has been chosen to denominate the pillars 128, 130 as "PTA" and "BTA" pillars, in different examples the functions and advantages of the pillars 128, 130 may vary and are not necessarily (only) related to the particles or bubbles, respectively, but may have additional or different functions and advantages.

In further examples the pillar structures 128, 130 serve the purpose of mitigating fluidic cross-talk between neighboring drop generators 124 that are in close proximity with one another, for example in addition to, or instead of, mitigating a negative influence of bubbles and/or particles. As previously noted, a smaller fluid ejection die 102 in the molded fluid ejection device 100 is enabled in part by the presence of fluid feed holes 114 and the associated ribs 120 that traverse the fluid channel 112 and add strength to the substrate 108. The reduced die size increases nozzle and drop generator density by bringing drop generators closer to one another across the channel 112 and width (W) of the substrate 108. The relatively high nozzle density in the fluid ejection device 100 could result in a relatively high level of fluidic cross-talk between neighboring drop generators 124. That is, as fluid drop generators are brought in closer proximity to one another, increasing fluidic cross-talk between neighboring ejection chambers can cause fluid pressure and/or volume changes in the chambers that may adversely impact drop ejections. In certain examples, the pillar structures 128, 130 structures in the fluidics layer 106 may serve to mitigate the impact of fluidic cross-talk.

The fluid ejection device 100 includes the fluid channel 112. The fluid channel 112 is formed through molded body 104 to enable fluid to flow directly onto the silicon substrate 108 at the back surface 110, and into the substrate 108 through the fluid feed holes 114. The fluid channel 112 can be formed in the molded body 104 in a number of ways. For example, a rotary or other type of cutting saw can be used to cut and define the channel 112 through the molded body 104 and a thin silicon cap (not shown) over the feed holes 114. Using saw blades with differently shaped peripheral cutting edges and in varying combinations, channels 112 can be formed having varying shapes that facilitate the flow of fluid to the back surface 110 of the substrate. In other examples, at least part of the channel 112 can be formed as the fluid ejection die 102 is being molded into the molded body 104 of the fluid ejection device 100 during a compression or transfer molding process. A material ablation process (e.g., powder blasting, etching, lasering, milling, drilling, electrical discharge machining) can then be used to remove residual molding material. The ablation process may enlarge the channel 112 and complete the fluid pathway through the molded body 104 to the fluid feed holes 114. When a channel 112 is formed using a molding process, the shape of the channel 112 generally reflects the inverse shape of the mold chase topography being used in the process. Accordingly, varying the mold chase topographies can yield a variety of differently shaped channels that facilitate the flow of fluid to the back surface 110 of the silicon substrate 108.

Figure 6:
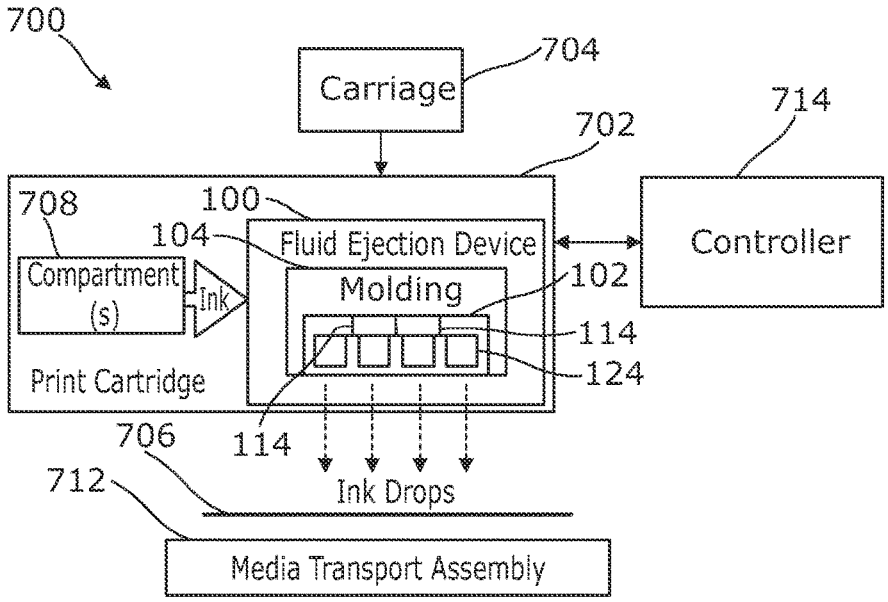
FIG. 6 is a block diagram illustrating an example printer with a print cartridge that incorporates an example of a molded fluid ejection device.

As noted above, the molded fluid ejection device 100 is suitable for use in, for example, a replaceable fluid ejection cartridge and/or a media-wide fluid ejection assembly ("print bar") of a 2D or 3D printer. FIG. 6 is a block diagram illustrating an example of a printer 700 with a replaceable print cartridge 702 that incorporates an example fluid ejection device 100, the fluid ejection device including a molding 104 and a die 102 embedded in the molding 104. The die includes fluid feed holes 114. In an example the printer is an inkjet printer and the cartridge 702 includes at least one ink compartment 708 that is at least partially filled with ink. Different compartments may hold different colors of ink. In one example of the printer 700, a carriage 704 scans print cartridge 702 back and forth over a print media 706 to apply ink to media 706 in a desired pattern. During printing, a media transport assembly 712 moves print media 706 relative to the print cartridge 702 to facilitate the application of ink to media 706 in a desired pattern. Controller 714 generally includes a processor, memory, electronic circuitry and other components to control the operative elements of the printer 700. The memory stores instructions to control the operative elements of the printer 700.

Figure 7:
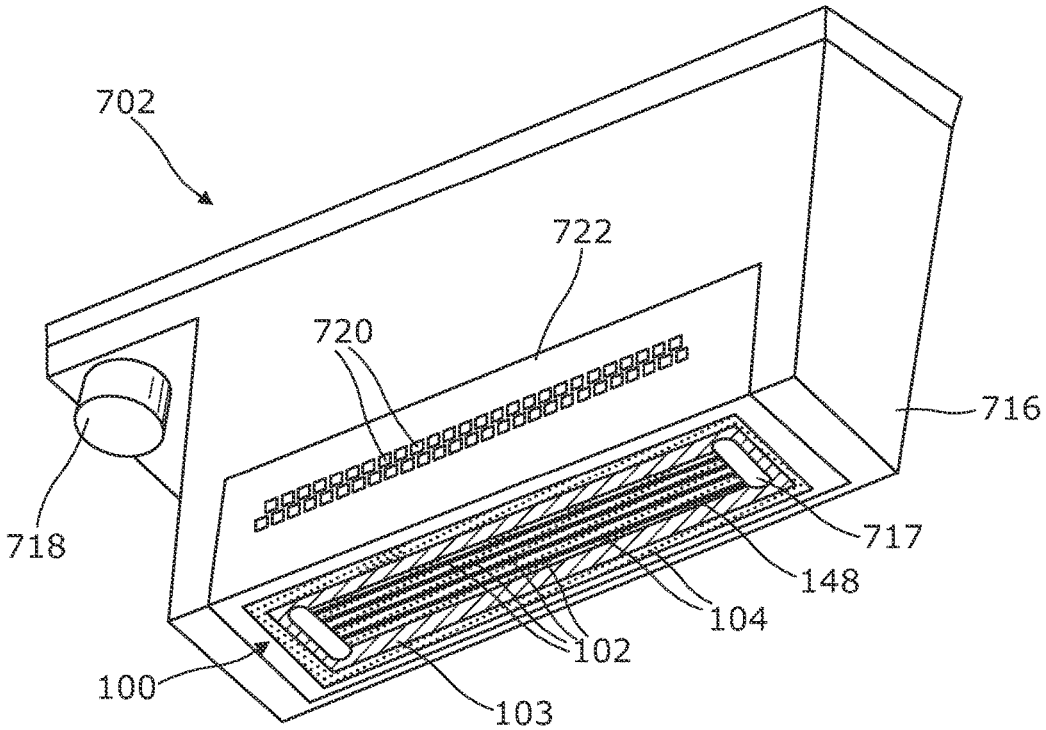
FIG. 7 illustrates a perspective view of an example print cartridge that incorporates an example of a molded fluid ejection device.

FIG. 7 illustrates a perspective view of an example print cartridge 702. The print cartridge 702 includes a molded fluid ejection device 100 supported by a cartridge housing 716. Fluid ejection device 100 includes four elongated fluid ejection dies 102 and a PCB (Printed Circuit Board) 103 mounted to a molding 104. The PCB may include electric and electronic circuitry such as drive circuitry to drive the fluid ejection elements in each die 102. In the illustrated example, the fluid ejection dies 102 are arranged parallel to one another across the width of fluid ejection device 100. The four fluid ejection dies 102 are located within a window 148 that has been cut out of PCB 103. While a single fluid ejection device 100 with four dies 102 is illustrated for print cartridge 702, other configurations are possible, for example with more fluid ejection devices 100 each with more or fewer dies 102.

The print cartridge 702 can be electrically connected to the controller 714 through electrical contacts 720. In an example, the contacts 720 are formed in a flex circuit 722 affixed to the housing 716, for example along one of the outer faces of the housing 716. Signal traces embedded in flex circuit 722 may connect the contacts 720 to corresponding circuitry on the fluid ejection die 102, for example through bond wires covered by a low profile protective cover 717 at the extremes of the fluid ejection dies 102. In an example Ink ejection nozzles on each fluid ejection die 102 are exposed through an opening in, or next to an edge of, the flex circuit 722 along the bottom of cartridge housing 716.

Figure 8:
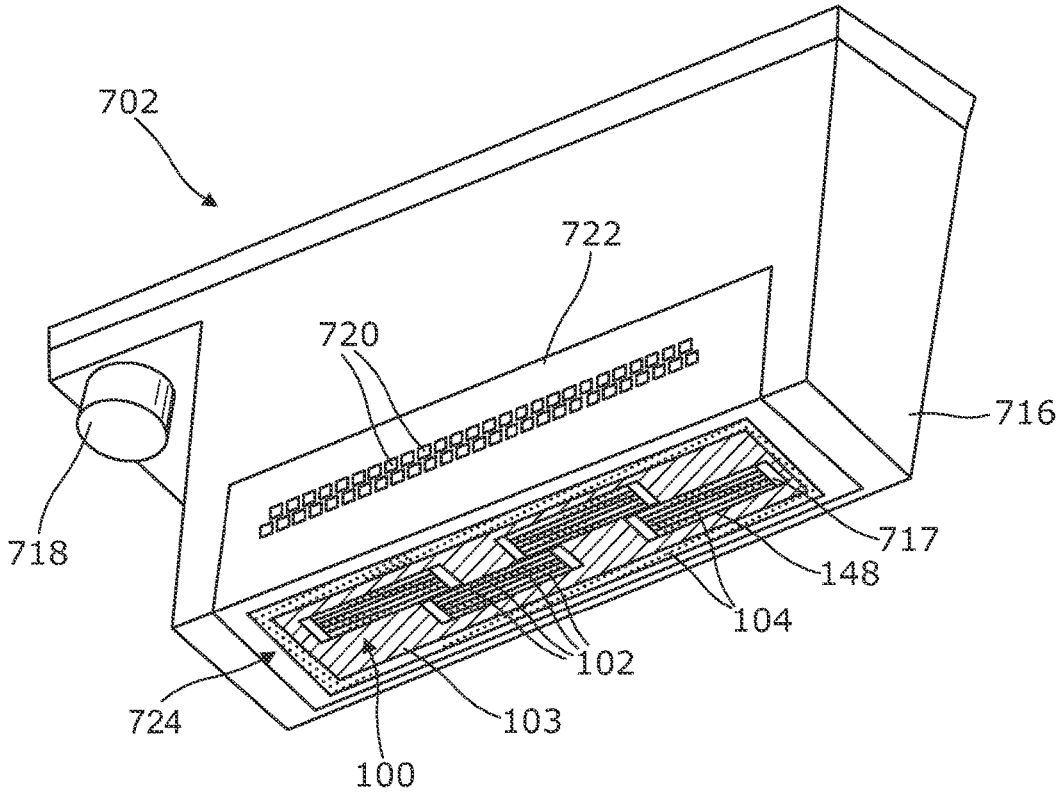
FIG. 8 illustrates a perspective view of another example print cartridge that incorporates an example of a molded fluid ejection device.

FIG. 8 illustrates a perspective view of another example print cartridge 702 suitable for use in a printer 700 or any other suitable high precision digital dispensing device. In this example, the print cartridge 702 includes a media wide fluid ejection assembly 724 with four fluid ejection devices 100 and a PCB 103 mounted to a molding 104 and supported by the cartridge housing 716. Each fluid ejection device 100 includes four fluid ejection dies 102 and is located within a window 148 cut out of the PCB 103. While a printhead assembly 724 with four fluid ejection devices 100 is illustrated for this example print cartridge 702, other configurations are possible, for example with more or fewer fluid ejection devices 100 that each have more or fewer dies 102. At each back side of each die 102, a mold channel may be provided through the mold to supply fluid to a fluidics layer of each die. At either end of the fluid ejection dies 102 in each fluid ejection device 100 bond wires may be provided, for example covered by a low profile protective coverings 717 comprising a suitable protective material such as an epoxy, and a flat cap placed over the protective material. Electrical contacts 720 are provided to electrically connect the fluid ejection assembly 724 to a printer controller 714. The electrical contacts 720 may connect to traces embedded in a flex circuit 722.

Figure 9:
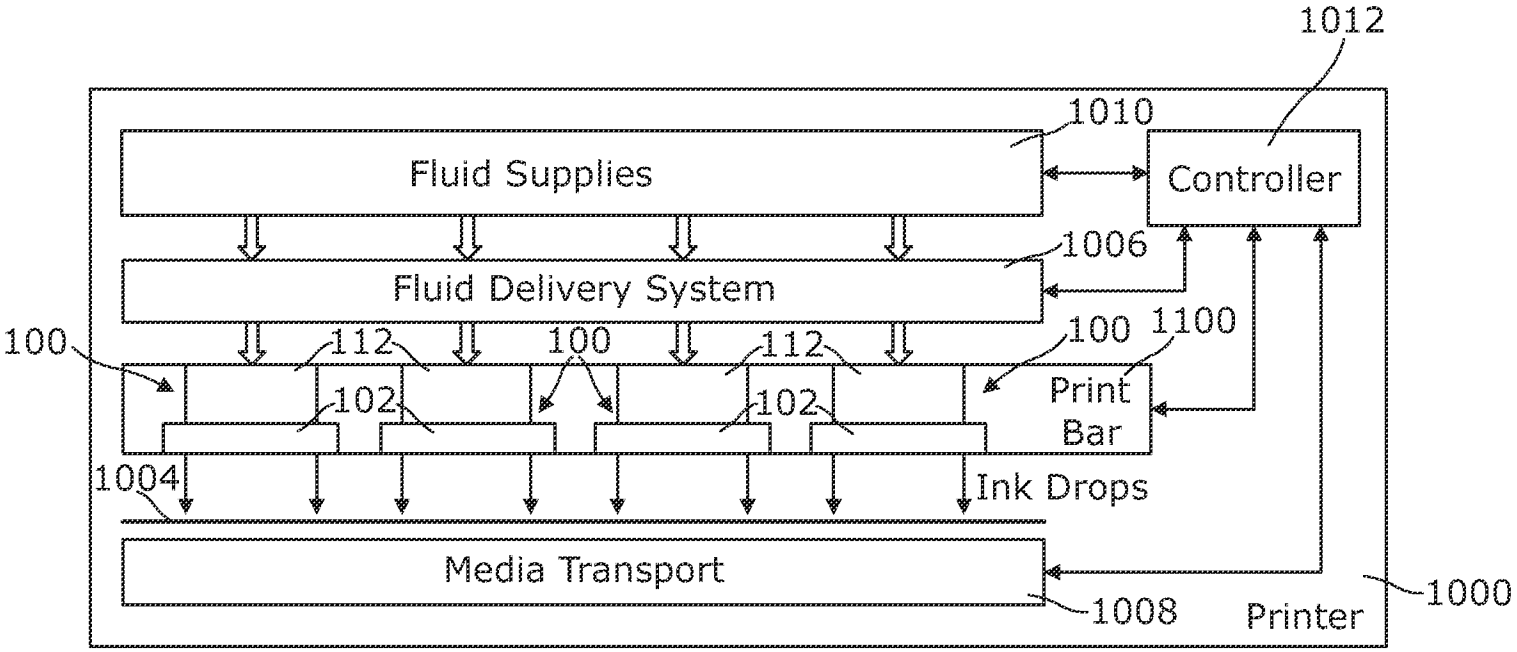
FIG. 9 is a block diagram illustrating another example printer with a media wide fluid ejection assembly including an example of a molded fluid ejection device.

FIG. 9 is a block diagram illustrating a printer 1000 with a fixed media wide fluid ejection assembly 1100 implementing another example of a molded fluid ejection device 100. Printer 1000 includes media wide fluid ejection assembly 1100 spanning the width of a print media 1004, a fluid delivery system 1006 associated with fluid ejection assembly 1100, a media transport mechanism 1008, a receiving structure for fluid supplies 1010, and a printer controller 1012. Controller 1012 includes a processor, a memory having control instructions stored thereon, and electronic circuitry and components needed to control the operative elements of a printer 1000. The fluid ejection assembly 1100 includes an arrangement of fluid ejection dies 102 for dispensing fluid on to a sheet or continuous web of paper or other print media 1004. In operation, each fluid ejection die 102 receives fluid through a flow path that runs from supplies 1010 into, through the fluid delivery system 1006 and fluid channels 112 into the fluid ejection dies 102.

Figure 10:
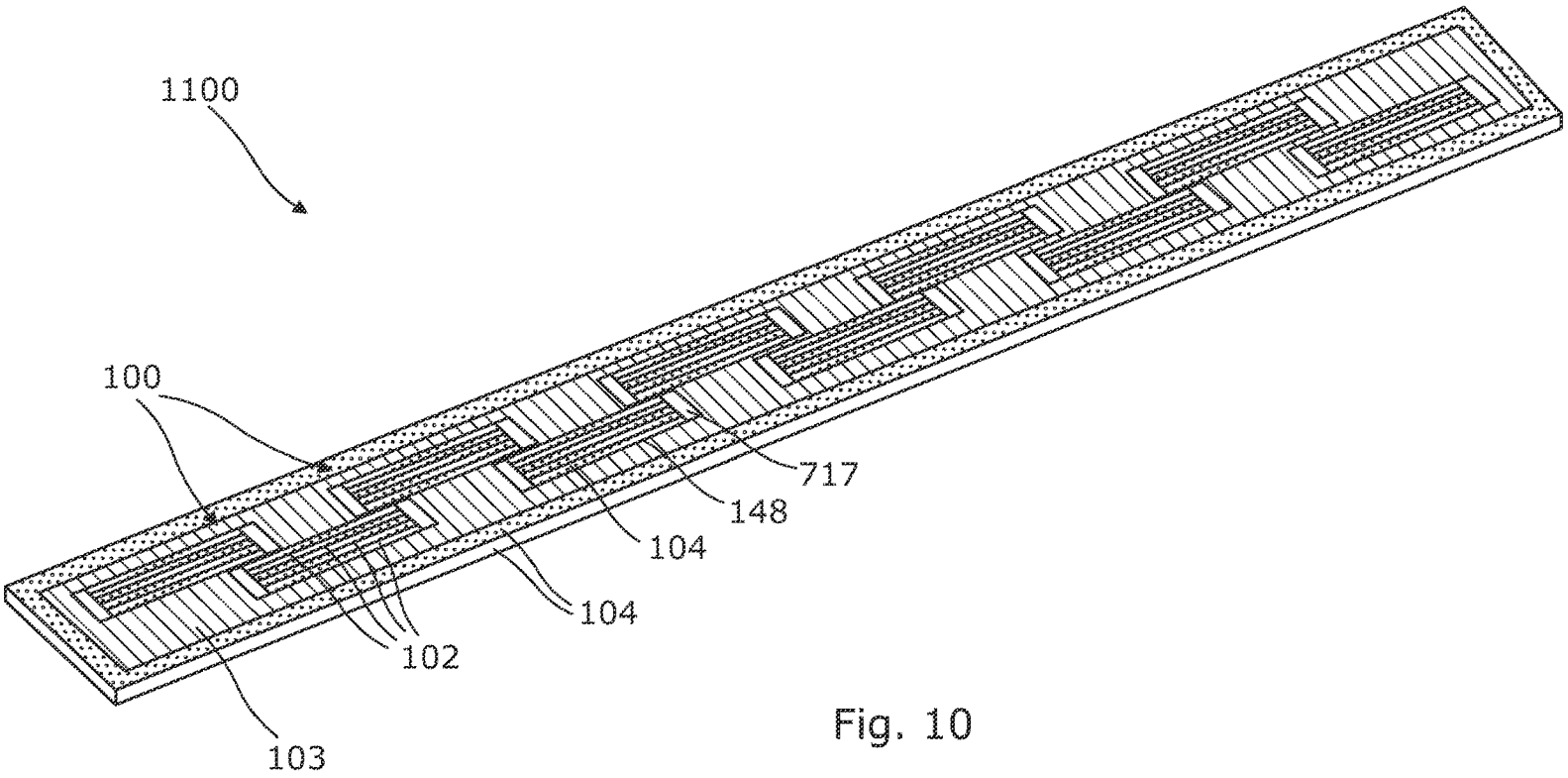
FIG. 10 is a perspective view illustrating an example fluid ejection assembly including fluid ejection devices.
Figure 11:
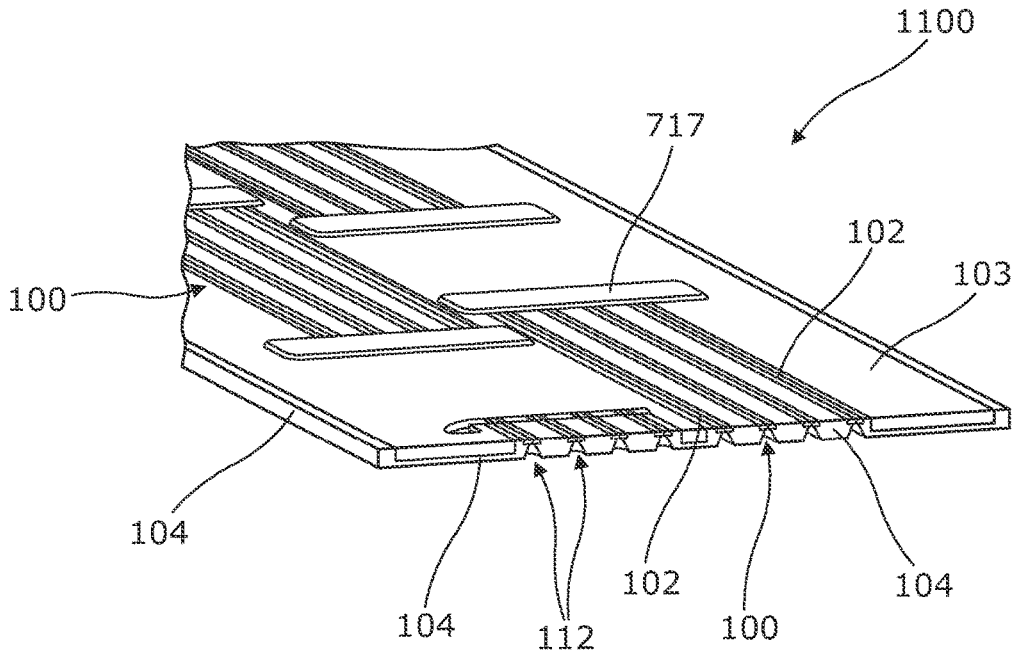
FIG. 11 is a perspective, section view illustrating the example fluid ejection assembly of FIG. 10.

FIGS. 10 and 11 illustrate perspective views of a molded media-wide fluid ejection assembly 1100 with multiple fluid ejection devices 100, for example for inclusion in a print cartridge, page wide array print bar or printer. FIG. 12 illustrates a different, section view of FIG. 11. The molded fluid ejection assembly 1100 includes multiple fluid ejection devices 100 and a PCB 103 that are both mounted to a molding 104. The fluid ejection devices 100 are arranged within windows 148 cut out of the PCB 103. The fluid ejection devices are arranged lengthwise in rows across the fluid ejection assembly 1100. The fluid ejection devices 100 of opposite rows are arranged in a staggered configuration with respect to each other so that each fluid ejection device 100 overlaps part of an opposite, adjacent fluid ejection device 100, as seen in a media advance direction. Hence some of the drop generators at the end of the fluid ejection dies 102 may be redundant because of the overlap. Although ten fluid ejection devices 100 are illustrated in FIG. 11, more or fewer fluid ejection devices 100 may be used in the same or a different configuration. At either end of the fluid ejection dies 102 of each fluid ejection device 100 bond wires can be provided that may be covered by low profile protective coverings 717 that may comprise a suitable protective material such as an epoxy, and a flat cap placed over the protective material.

In some of the examples of this disclosure, a fluid ejection die is provided in a molding. The molding includes an elongate channel. The die is embedded in the mold. In one example, the die is provided in a cut out window of a PCB that is also embedded in the mold. A row of fluid feed holes extends parallel to a length axis of the elongate molding channel. Ribs between the fluid feed holes extend across the mold channel. Two rows of drop generators extend along the fluid feed hole downstream openings, for example one row at each side of the fluid feed hole openings, so that the ribs extend between the two rows of drop generators. Pillars may be provided on top of the ribs, between the drop generator rows. Pillars may also be provided near chamber inlets. A single, common manifold may be provided that fluidically connects to each of the chambers and fluid feed holes. In some example a pitch of the fluid feed holes is the same as a pitch of the drop generators in one row of drop generators.

In one example, one mold channel is to provide fluid to one fluid feed hole array (e.g. row). In another example, one mold channel may provide fluid to a plurality of feed hole arrays (e.g. rows) either in a single die or in multiple corresponding dies. In this disclosure, the dies may be of relatively small width, for example having a ratio of length to width of 50 or more. Such dies may be called "slivers". The dies may also be relatively thin, for example generally consisting of a bulk silicon substrate and a thin film fluidics layer.

In the illustrated examples, the multiple fluid ejection devices and PCB that are mounted to a molding 104. In this disclosure mounting includes both attached to and embedded. In one example, the fluid ejection devices are embedded, for example overmolded, in the molding, while the PCBs are attached to the molded fluid ejection device after said embedding. The PCBs include a window that exposes the dies. In another example both the fluid ejection device and PCB are embedded in the molding.

In one example, it was found that using feed hole arrays rather than longitudinal feed slots may have a positive influence on heat transfer in the die. For example the fluid may better cool the die.

What is claimed is:

1. A fluid ejection device, comprising:

a fluid ejection die having a fluidics layer to dispense fluid and a substrate with a front surface on which the fluidics layer is formed and a back surface to receive fluid;

an array of fluid feed holes each extending through the substrate from the back surface to the front surface to guide fluid to the fluidics layer, the substrate including a rib separating each fluid feed hole from an adjacent fluid feed hole;

an array of drop generators in the fluidics layer downstream of and parallel to the array of fluid feed holes;

a manifold formed in the fluidics layer, the fluid feed holes opening into the manifold, and the manifold extending along the drop generator array to supply fluid to the drop generators; and multiple first pillars each positioned in the manifold on a rib between adjacent fluid feed holes.

2. The fluid ejection device of claim 1, comprising a molding, and an elongate channel in the molding along the back surface of the substrate to convey fluid to the feed holes.

3. The fluid ejection device of claim 1 wherein each first pillar is rectangular and covers an area between adjacent fluid feed holes smaller than an area of the corresponding rib.

4. The fluid ejection device of claim 1 wherein each first pillar has a width at least half the width of an adjacent fluid feed hole opening into the manifold.

5. The fluid ejection device of claim 1 wherein the rib separating each fluid feed hole from an adjacent fluid feed hole is a single rib.

6. The fluid ejection device of claim 1 wherein the die is between 150 and 550 microns wide.

7. The fluid ejection device of claim 1, wherein each drop generator comprises:

an ejection chamber;

an inlet between the ejection chamber and the manifold;

a nozzle over the ejection chamber; and an ejection element in the ejection chamber to eject fluid from the ejection chamber through the nozzle.

8. The fluid ejection device of claim 7 comprising multiple second pillars each located in the manifold between the inlet to an ejection chamber and the array of fluid feed holes.

9. The fluid ejection device of claim 7 wherein the inlet to each ejection chamber is pinched so that a maximum width of the inlet is less than a diameter of the ejection chamber.

10. The fluid ejection device of claim 1 wherein each fluid feed hole is tapered so that an opening into the feed hole at the front surface of the silicon substrate is smaller than an opening into the feed hole at the back surface of the silicon substrate and each silicon rib narrows as it extends from the front surface to the back surface of the silicon substrate in correspondence with the tapered feed holes.

11. A fluid ejection device, comprising:

a fluid ejection die having a fluidics layer to dispense fluid and a substrate with a front surface on which the fluidics layer is formed and a back surface to receive fluid;

an array of fluid feed holes each extending through the substrate from the back surface to the front surface to guide fluid to the fluidics layer, the substrate including a rib separating each fluid feed hold from an adjacent fluid feed hole;

an array of drop generators in the fluidics layer downstream of and parallel to the array of fluid feed holes;

a manifold formed in the fluidics layer, the fluid feed holes opening into the manifold, and the manifold extending along the drop generator array to supply fluid to the drop generators; and each drop generator comprising:

an ejection chamber;

an inlet between the ejection chamber and the manifold;

a nozzle over the ejection chamber; and an ejection element in the chamber to eject fluid from the chamber through the nozzle, the inlet to the ejection chamber pinched so that a maximum width of the inlet is less than ⅔of a diameter of the ejection chamber.

12. The fluid ejection device of claim 11 comprising a first pillar structure located in the manifold outside of and adjacent to each inlet.

13. The fluid ejection device of claim 11 comprising a second pillar structure located in the manifold on each rib.

14. A fluid ejection assembly, comprising:

a molding having a channel therein;

a fluid ejection die embedded in the molding;

wherein the die includes a silicon substrate having a back surface exposed to the channel in the molding and a front surface opposite the back surface, a row of drop generators on the front surface of the silicon substrate, a row of fluid feed holes through, and spaced lengthwise along, the substrate, the row of fluid feed holes parallel to the row of drop generators, to convey fluid from the channel in the molding to the row of drop generators, and silicon ribs interleaved between the fluid feed holes; and multiple pillars extending from the front surface of the silicon substrate, each pillar positioned on a rib to guide air bubbles into the fluid feed holes.

15. The fluid ejection assembly of claim 14, wherein the fluid ejection die comprises multiple fluid ejection dies arranged parallel to one another laterally across the molding.

16. The fluid ejection assembly of claim 15, wherein the fluid ejection dies are arranged parallel to one another laterally across the molding in a staggered configuration in which end portions of adjacent dies overlap.

* * * * *